US005997245A

United States Patent [19]

Tomita et al.

[11] Patent Number: 5,997,245

[45] Date of Patent: Dec. 7, 1999

[54] COOLED SHROUD OF GAS TURBINE STATIONARY BLADE

[75] Inventors: Yasuoki Tomita; Hiroki Fukuno; Hideki Murata; Kiyoshi Suenaga, all of Takasago, Japan

[73] Assignee: Mitsubishi Heavy Industries, Ltd., Tokyo, Japan

[21] Appl. No.: 09/064,987

[22] Filed: Apr. 23, 1998

[51] Int. Cl.[6] ..... F01D 5/18

[52] U.S. Cl. ..... 415/115; 415/116; 416/96 A; 416/96 R; 416/97 R; 416/97 A; 416/90 R

[58] Field of Search ..... 415/115, 116; 416/96 A, 96 R, 97 R, 97 A, 90 R

[56] References Cited

U.S. PATENT DOCUMENTS

| | | | |
|---|---|---|---|
| 5,344,283 | 9/1994 | Magowan et al. | 415/115 |
| 5,413,458 | 5/1995 | Calderbank | 415/115 |
| 5,848,876 | 12/1998 | Tomita | 416/96 R |

*Primary Examiner*—Edward K. Look
*Assistant Examiner*—Matthew T. Shanley
*Attorney, Agent, or Firm*—Wenderoth, Lind & Ponack, L.L.P.

[57] ABSTRACT

The invention relates to a cooled shroud in a gas turbine stationary blade which is able to flow a cooling air in the entire area of an inner shroud for cooling thereof. Three stationary blades are fixed to the inner shroud 2, a cover 13, 14 is provided to form a space 21 and space 22*a*, 22*b* and 22*c*, respectively. The cooling air is introduced through an independent air passage 3A of a leading edge of each stationary blade into the spaces 22*a*, 22*b* and 22*c* and is flown therefrom through a tunnel 18 and air reservoirs 19-2, 19-3 and 19-4 to be blown out of a trailing edge while cooling surfaces of the shrouds and the trailing edges. Also, a portion of the cooling air from the space 22*b* is flown into the space 21 through a tunnel 11, a leading edge side passage 12 and an endmost tunnel 11 and is then blown out of the trailing edge through a tunnel 18 and an air reservoir 19-1, so that the leading edge portion, the endmost portion and the endmost trailing edge portion are cooled. By use of the independent air passage, the cooling air is introduced to cool the entire area of the shroud.

2 Claims, 6 Drawing Sheets

COOLED SHROUD OF GAS TURBINE STATIONARY BLADE

BACKGROUND OF THE INVENTION

1. Field of the Invention

The present invention relates to a cooled shroud having a cooling structure in a gas turbine stationary blade.

2. Description of the Prior Art

FIG. 5 is a perspective view showing one typical example of a cooling system in a prior art gas turbine stationary blade. In the figure, numeral 30 designates a stationary blade, numeral 31 designates an outer shroud thereof and numeral 32 designates an inner shroud. Numeral 33, 34 and 35, respectively, designates an insert, arranged in the order of place from a leading edge side toward a trailing edge side, inserted in the direction from the outer shroud 31 toward the inner shroud 32, numeral 33*a*, 34*a* and 35*a*, respectively, designates an air injection hole provided to the respective insert and numeral 36 designates a trailing edge fin. Numeral 37 generally designates an air injection hole provided in a blade surface for blowing air, wherein numerals 37*a* and 37*c* are shown in the figure and numeral 37*b* is not shown.

In the stationary blade 30 of the above structure, cooling air is introduced through the outer shroud 31 and the inner shroud 32, respectively, into the inserts 33, 34 and 35 and is blown from the air injection holes 33*a*, 34*a* and 35*a* toward a blade inner surface to perform an impingement cooling of the blade inner surface and is then blown from the air injection holes 37*a*, 37*b* and 37*c*, provided in the blade surface, to perform a shower head cooling, a film cooling and a pin fin cooling of the blade.

Also, as for the cooling of the shroud, it is done, as shown in the figure as one example, such that the cooling air which flows in is injected to impinge rectangularly on an impingement plate 39 which is provided in the inner shroud 32 in parallel thereto so that the air passes through a multiplicity of holes to be diffused to cool an entire surface of the inner shroud 32 and is then flown out of a rear end of the shroud.

FIG. 6 shows another example of a stationary blade cooling system. In the figure, numeral 40 designates a stationary blade, numeral 41 designates an outer shroud thereof and numeral 42 designates an inner shroud. Numeral 43A, 43B, 43C, 43D and 43E, respectively, designates an air passage, numeral 45 designates an air injection hole of a trailing edge and numeral 46 designates a turbulator provided to an inner wall of the air passage 43A to 43D, respectively, for making the air flow there turbulent for enhancement of a heat transfer.

In the present stationary blade cooling system, a cooling air 47 flows in from the outer shroud 41 into the air passage 43A to flow to a base portion, to enter therefrom the next air passage 43B, to flow to a tip portion, to enter therefrom the next air passage 43C and then likewise to flow in the air passages 43D and 43E, sequentially, to cool the blade, and is blown out of the air passage 43E through the air injection hole 44 of the trailing edge and a remaining air flows down out of the inner shroud 42.

In the cooling system shown in FIG. 6, while there is constructed a serpentine cooling passage by the air passages 43A to 43E so that air flows there to cool the blade, there is considered nothing of a cooling of the shroud.

In the prior art gas turbine cooling system as described above, the cooling of the shroud is done, as the example shown in FIG. 5, such that the cooling air is flown to impinge on the impingement plate provided in the shroud and is flown in the shroud through the multiplicity of holes to cool the shroud and then is discharged through an air passage in the rear end of the shroud, however, there is applied no cooling of the shroud in the stationary blade of a turbine rear stage side, as shown in FIG. 6.

The cooling of the shroud by use of such an impingement plate as mentioned above is not necessarily sufficient and, moreover, there are many cases where such cooling is done on the shroud on a turbine front stage side but no cooling is done on the turbine rear stage side, hence, a means for further enhancing the cooling effect as a whole has been desired.

SUMMARY OF THE INVENTION

It is therefore a first object of the present invention to provide a cooled shroud having a structure to perform an air cooling of a stationary blade as well as to perform an effective cooling of the shroud by arranging air passages and spaces so as to supply a cooling air uniformly in the entire shroud.

Further, it is a second object of the present invention to provide a cooled shroud having a structure to perform an integrated cooling of the shroud including a plurality of stationary blades by arranging the plurality of stationary blades in a segment of one inner shroud.

In order to attain said first and second objects, the present invention provides following means of (1) and (2) below:

(1) A cooled shroud of a gas turbine stationary blade in which a cooling air is supplied into an inner shroud through a stationary blade leading edge side air passage, characterized in that an interior of said inner shroud is sectioned into a ventral side and a dorsal side so as to form a first space on the ventral side and a second space on the dorsal side, said first space communicating with said stationary blade leading edge side air passage, and there is provided on a leading edge side of said inner shroud a shroud side air passage for causing said first space and second space to communicate with each other and the cooling air which flows into said first space from said stationary blade leading edge side air passage is discharged to a trailing edge side from said first space on one hand, and is flown into said second space through said shroud side air passage and is discharged to the trailing edge side from said second space on the other hand.

(2) A cooled shroud of a gas turbine stationary blade as mentioned in (1) above, characterized in that said inner shroud is fixed with a plurality of stationary blades in the circumferential direction, said second space is formed on the dorsal side of the stationary blade of the endmost portion and said first space is formed so as to cover all the remaining stationary blades.

In the invention of (1) above, the cooling air passes through the stationary blade leading edge side air passage to enter the first space of the inner shroud. A portion of the cooling air in the first space passes through the inner shroud side air passage to enter the second space while cooling the shroud leading edge side. The cooling air which has entered the first and second spaces is blown out of the trailing edge while cooling the surface of the shroud on the ventral side and dorsal side, respectively, of the stationary blade, so that cooling of the trailing edge portion also is effected. The cooling air is so introduced through the independent air passage in the stationary blade leading edge portion to flow in the first and second spaces and the shroud side air passage, thus the surroundings, leading edge portion and trailing edge portion of the inner shroud are cooled uniformly.

In the invention of (2) above, a plurality of stationary blades are fixed to one inner shroud and the cooling air passes through the air passage of each of the plurality of stationary blades to enter the respective first space and a portion of the cooling air passes through the shroud side air passage to enter the second space while cooling the shroud leading edge side, same as in (1) above. Thus, in the second space, the shroud surface on the dorsal side of the endmost stationary blade is cooled, and in the first space, the shroud surfaces of the remaining stationary blades are cooled. Then, the cooling air is discharged to the trailing edge and the entire area of the shrouds of the plurality of stationary blades can be cooled uniformly, same as in (1) above.

DESCRIPTION OF THE PREFERRED EMBODIMENTS

Figure 1:
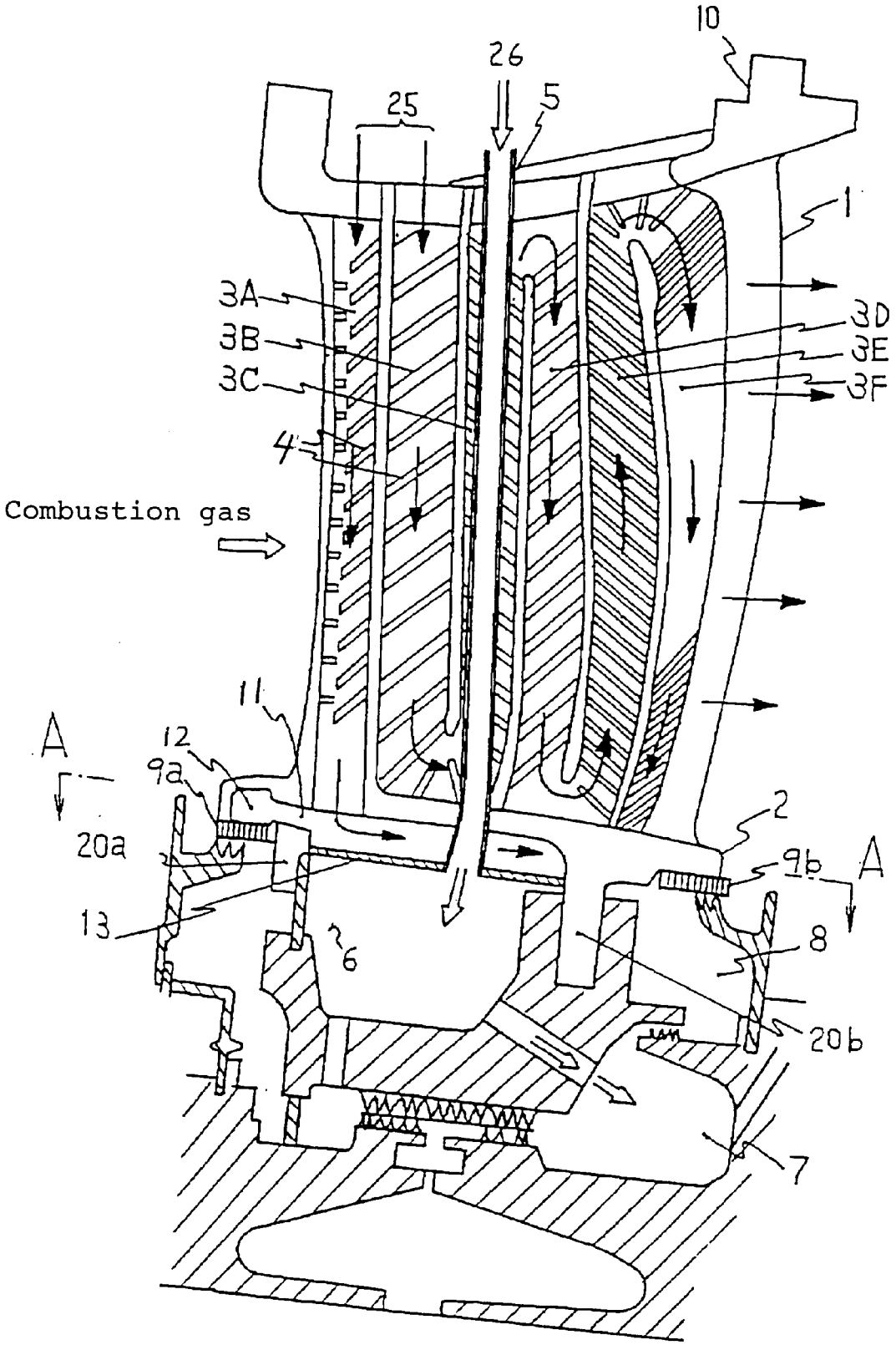
FIG. 1 is a cross sectional view of an interior of a cooled shroud of a gas turbine stationary blade of a first and second embodiments according to the present invention.
Figure 2:
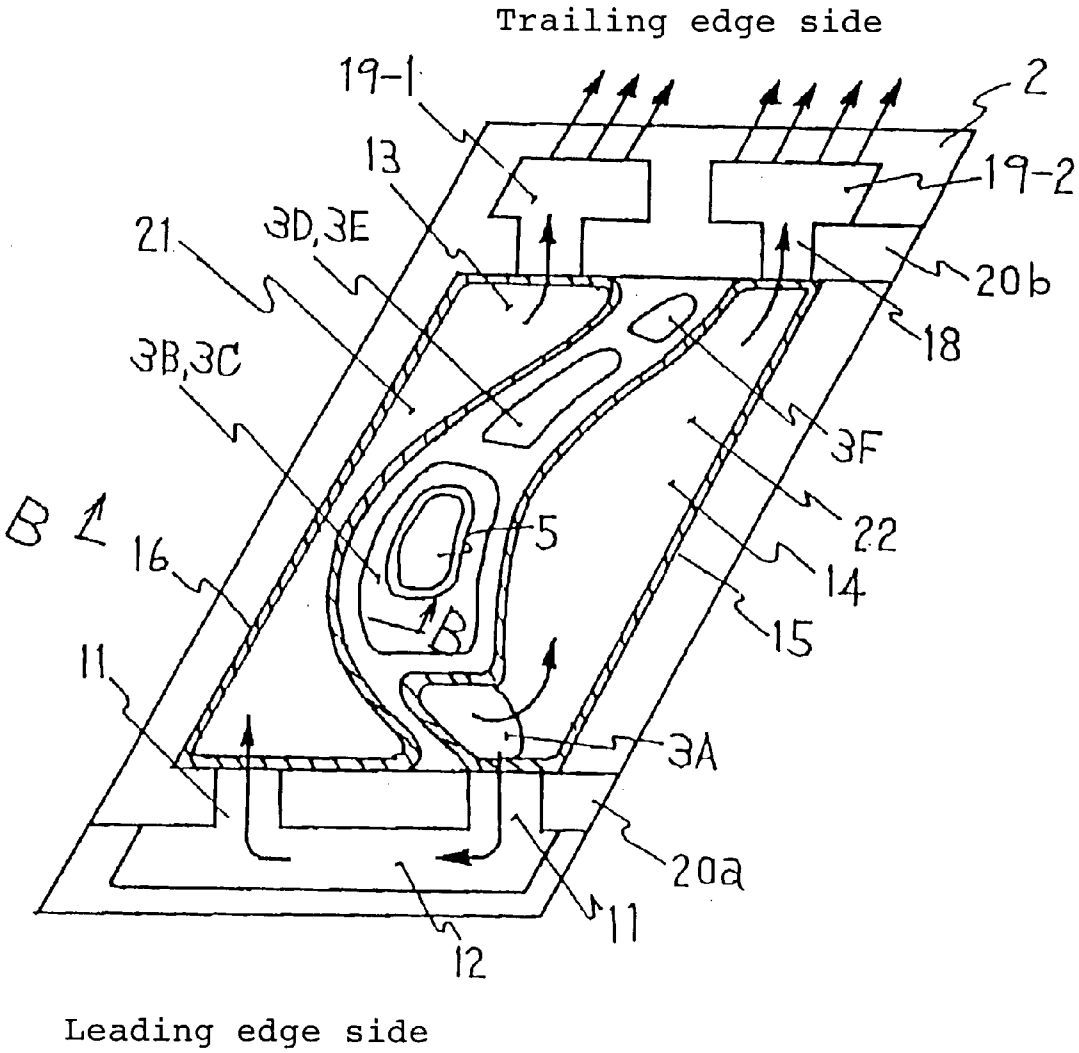
FIG. 2 is a cross sectional view taken on line A—A of FIG. 1 and shows the cooled shroud of the first embodiment of the present invention.

Herebelow, description will be made concretely on embodiments according to the present invention with reference to figures. FIG. 1 is a cross sectional view of an interior of a gas turbine stationary blade to which a cooled shroud of a first embodiment according to the present invention is applied and FIG. 2 is a cross sectional view taken on line A—A of FIG. 1 and shows an interior of an inner shroud thereof.

In FIG. 1, numeral 1 designates a stationary blade, numeral 2 designates an inner shroud thereof and numeral 10 designates an outer shroud thereof. Numeral 3A, 3B, 3C, 3D, 3E and 3F, respectively, designates an air passage in the blade, wherein the air passage 3A is an independent passage on a leading edge side, and 3B which communicates with 3C on a base portion side, 3C which communicates with 3D on a tip portion side, 3D which communicates with 3E on the base portion side and 3E which communicates with 3F on the tip portion side form a serpentine cooling passage.

Numeral 4 designates a turbulator provided to an inner wall of the air passage 3A to 3F, respectively, for making a flow of air turbulent for enhancement of a heat transfer. In the air passage 3A, there are provided a turbulator on the leading edge side which is rectangular to the flow of the cooling air and a turbulator on a rear side thereof which is inclined to the flow of the cooling air. Numeral 5 designates a tube for receiving a sealing air 26 to lead it into a cavity 6 of a lower portion thereof to make a high pressure therein. Numeral 7 and 8, respectively, designates also a cavity and the respective cavity 6, 7 and 8 stores a high pressure low temperature cooling air, the high pressure air of which prevents an outside high temperature combustion gas from entering therein.

Numeral 9*a* designates a cover to which a front honeycomb seal is provided and numeral 9*b* designates a cover to which a rear honeycomb seal is provided. Numeral 11 designates a tunnel formed by a rib 20*a* in the inner shroud 2, numeral 12 designates a leading edge side passage of the inner shroud 2 and numeral 13 designates a cover of a lower portion of the inner shroud 2. Numeral 20*a*, as mentioned, and 20*b*, respectively, designates a rib of the lower portion of the inner shroud 2.

In FIG. 2, one piece of the stationary blade is fixed to the inner shroud 2 and therein provided are the air passages 3A, 3B, 3C, 3D, 3E and 3F and the tube 5 for the sealing air. The tunnel 11 is formed by the rib 20*a* of the leading edge side at two places, one on each side of the shroud, so as to communicate with a space 21 (corresponding to a second space of the present invention) and a space 22 (corresponding to a first space of the present invention). The leading edge side passage 12 communicates with the tunnel 11 at each end thereof.

Figure 3:
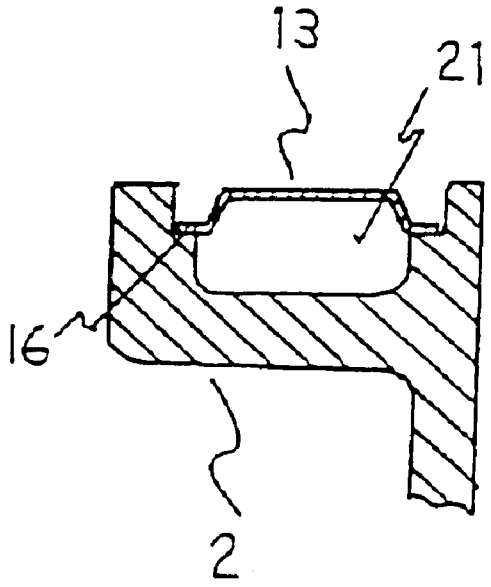
FIG. 3 is a cross sectional view taken on line B—B of FIG. 2.

The cover 13 covers surroundings of a dorsal side of the stationary blade, abutting at its edge on a bank 16 of the inner shroud 2, as shown in FIG. 3 which is a cross sectional view taken on line B—B of FIG. 2, to form the space 21 (the second space. Numeral 14 designates also a cover, which abuts on a bank 15 to cover surroundings of a ventral side of the stationary blade and to form the space 22 (the first space).

The space 22 communicates with the base portion side of the air passage 3A of the leading edge portion of the stationary blade and the cooling air is introduced there through the air passage 3A from the outer shroud 10. Numeral 18 designates a tunnel formed by a rib 20*b* of a trailing edge side, which tunnel is provided at two places so as to communicate with an air reservoir 19-1 and 19-2, respectively, and the air is blown out of holes of the trailing edge side from these air reservoirs.

In the cooled shroud of the gas turbine stationary blade constructed as shown in FIG. 1, the sealing air 26 flows into the tube 5 through the outer shroud 10 to enter the cavity 6 of the lower portion of the inner shroud and to further flow therefrom into the cavities 7 and 8 to make a high pressure therein, so that a high temperature gas from a combustion gas passage is prevented from coming therein.

The cooling of the blade is done such that the cooling air 25 enters the air passage 3B through the outer shroud 10 to flow from the base portion of the air passage 3B into the air passage 3C, to flow from the tip portion of the air passage 3C into the air passage 3D, and then from the base portion of 3D into 3E and from the tip portion of 3E into 3F, to cool the blade and then is blown out of holes of the trailing edge side of the air passage 3F.

Next, a cooling of the inner shroud 2 will be described. In FIG. 1, the cooling air 25 enters the air passage 3A of the leading edge side. The air passage 3A being provided independent of the other air passages, the air which has cooled the leading edge flows in its entirety into the inner shroud 2. The rectangular turbulator and the inclined turbulator in the air passage 3A give especially a large effect of cooling of the leading edge side. The cooling air flowing in the air passage 3A flows in the inner shroud 2 as shown in FIG. 2.

In FIG. 2, the air passage 3A communicates with the space 22. That is, the air passage 3A of the stationary blade communicates with the space 22 and the cooling air flows first into the space 22.

The cooling air which has flown into the space 22 flows toward the trailing edge side while cooling a surface of the shroud central portion and further flows through the tunnel 18 to enter the air reservoir 19-2 and is then blown out of holes of the trailing edge side while cooling an entire area of the trailing edge side.

A portion of the cooling air in the space 22 passes through the tunnel 11 of the right side end in FIG. 2, through the leading edge side passage 12 while cooling the leading edge side and through the tunnel 11 of the left side end in FIG. 2 and enters the space 21. The cooling air in the space 21 flows through the tunnel 18 of the left side end while cooling a surface of the left side end portion of the inner shroud 2 to enter the air reservoir 19-1 and is then blown out of holes of the trailing edge side while cooling the trailing edge side of the left side end.

Figure 4:
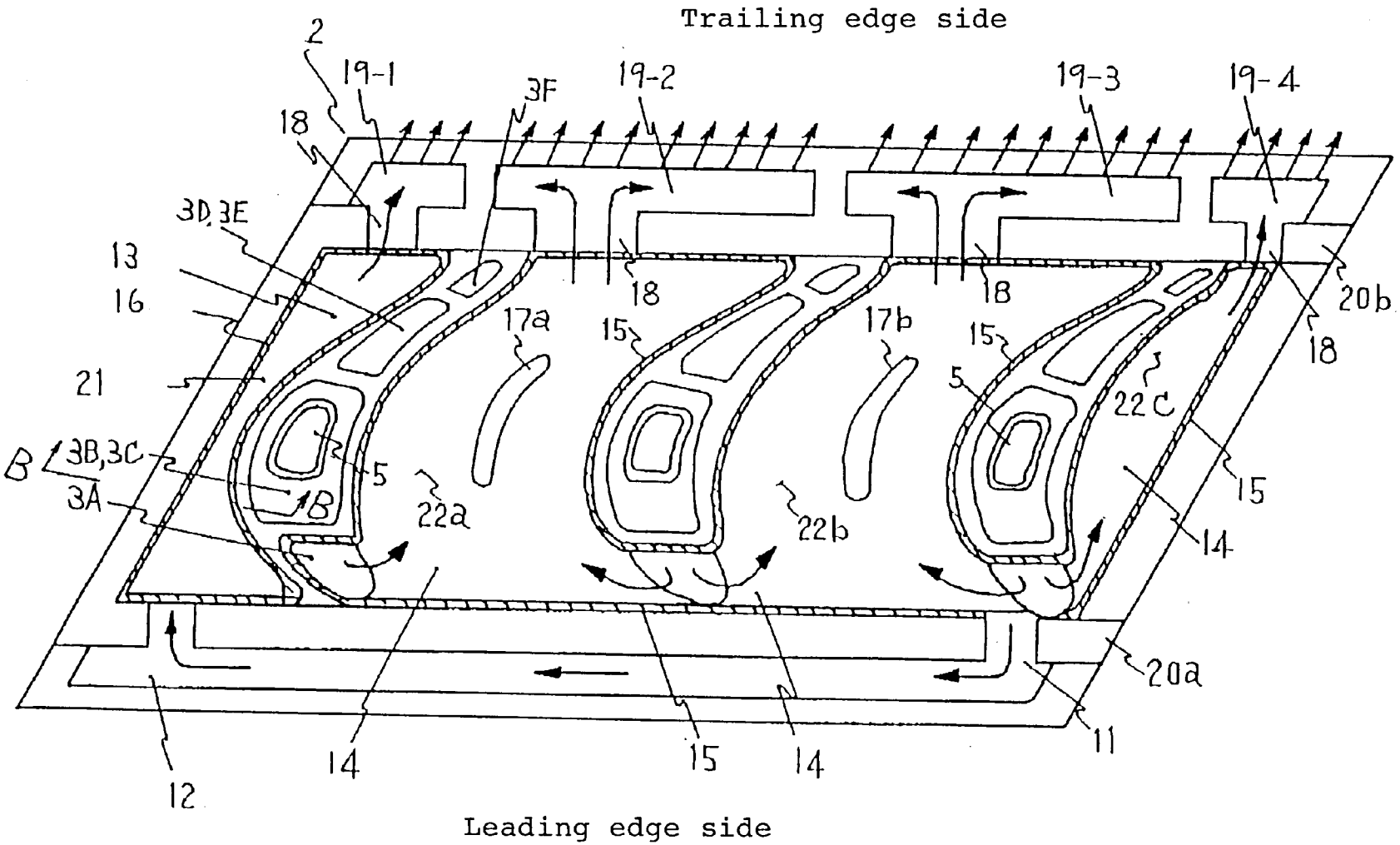
FIG. 4 is a cross sectional view of an interior of the cooled shroud of a gas turbine stationary blade of the second embodiment of the present invention.
Figure 5:
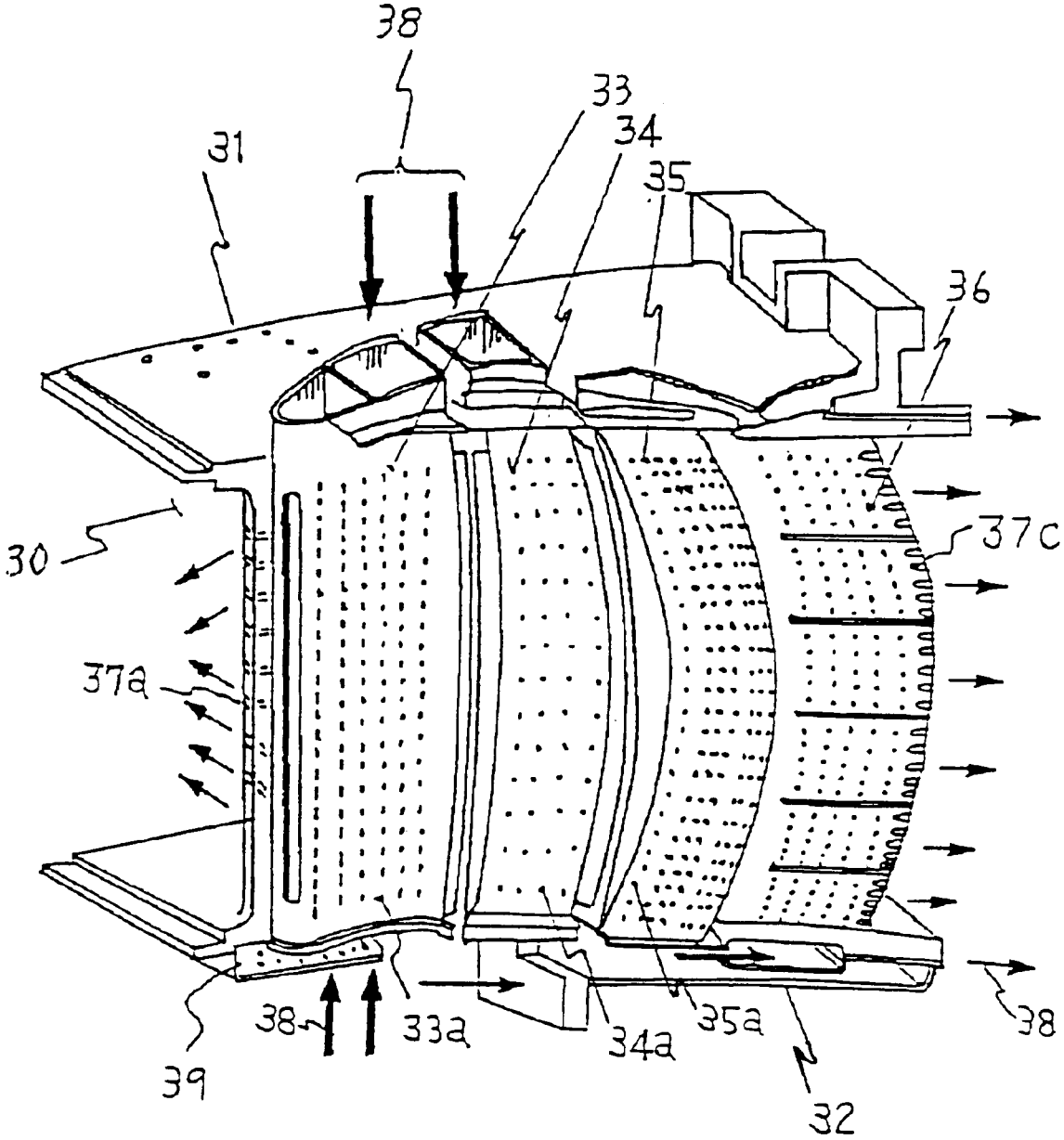
Fig. 5 (Prior Art)
FIG. 5 is a perspective view showing a cooling structure of a prior art gas turbine stationary blade.
Figure 6:
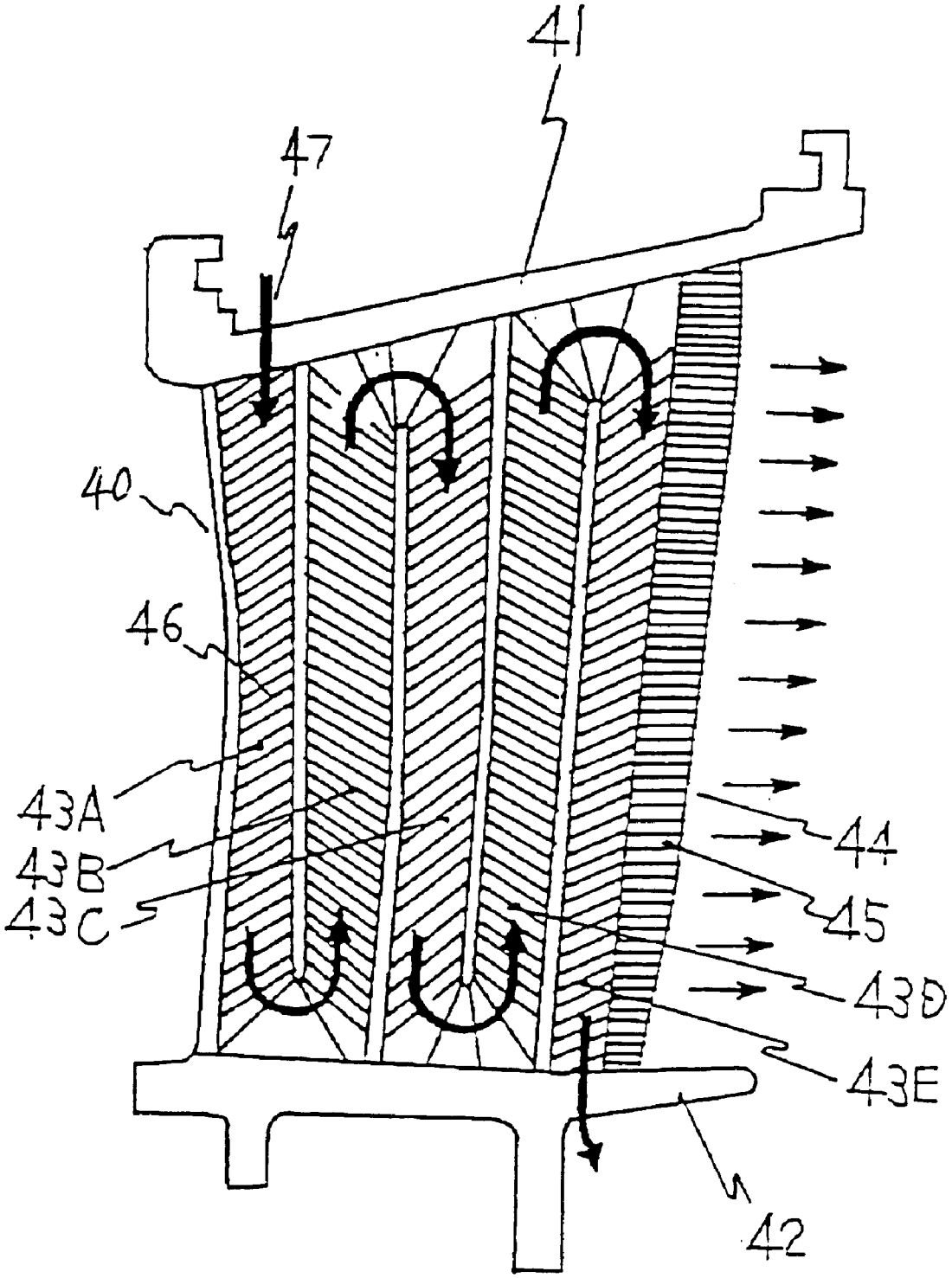
Fig. 6 (Prior Art)
FIG. 6 is a cross sectional view showing an interior of another cooling structure of a prior art gas turbine stationary blade.

FIG. 4 is a cross sectional view of an interior of a cooled shroud of a second embodiment according to the present invention. In FIG. 4, a different point from the first embodiment is that the cooled shroud is fixed with three stationary blades integrally. That is, three stationary blades are fixed to the inner shroud 2 integrally and, as shown by numerals representatively for the stationary blade of the left side end in FIG. 4, there are provided air passages 3A, 3B, 3C, 3D, 3E and 3F and a tube 5 for a sealing air for each of the stationary blades. Numeral 11 designates a tunnel formed by a rib 20*a* of a leading edge side, which tunnel is provided at two places of each side of the shroud so as to communicate with space 21 and 21*b*, respectively. Numeral 12 designates a leading edge side passage, which is same as mentioned above and communicates at its each end with the tunnel 11.

Numeral 13 designates a cover for covering surroundings of a dorsal side of the stationary blade of the left side end, which cover abuts at its edge on a bank 16 of the inner shroud 2 to form the space 21. Numeral 14 designates also a cover, which abuts on a bank 15 to cover entire surroundings of the remaining stationary blades of the middle and the right side end and forms spaces 22*a*, 22*b* and 22*c*.

The space 22*a*, 22*b* and 22*c*, respectively, communicates with a base portion side of the air passage 3A of the leading edge portion of each of the three stationary blades and a cooling air is introduced there through the air passage 3A from an outer shroud 10. In the space 22*a* and 22*b*, respectively, there is provided a spacer 17*a*, 17*b*. Numeral 18 designates a tunnel formed by a rib 20*b* of the trailing edge side, which tunnel is provided at four places to communicate with air reservoir 19-1, 19-2, 19-3 and 19-4, respectively, and the cooling air therefrom is blown out of holes of the trailing edge side.

In the second embodiment constructed as above, cooling of the blade being done in the same way as described for the first embodiment, repeated description thereof is omitted and cooling of the inner shroud will be described. A cooling air 25 enters the air passage 3A of the leading edge side. The air passage 3A being provided independent of the other air passages, the air which has cooled the leading edge flows in its entirety into the inner shroud 2. Three stationary blades are fixed to the inner shroud 2 integrally, as shown in FIG. 4, and the cooling air which has flown from the air passage 3A of each of the stationary blades flows into the inner shroud 2.

Each air passage 3A communicates with the space 22*a*, 22*b* and 22*c* such that the air passage 3A of the stationary blade of the left side end in the figure communicates with the space 22*a*, the air passage 3A of the middle communicates with the spaces 22*a* and 22*b* and the air passage 3A of the stationary blade of the right side end communicates with the spaces 22*b* and 22*c*, and the cooling air flows first into the spaces 22*a*, 22*b* and 22*c*.

The cooling air which has flown in the spaces 22*a*, 22*b* and 22*c* flows further to the trailing edge side while cooling a surface of a central portion of the shroud 2 to enter the air reservoirs 19-2, 19-3 and 19-4 through the tunnels 11 of three places and is then blown out of holes of the trailing edge side while cooling an entire area of the trailing edge side.

A portion of the cooling air in the space 22*b* passes through the tunnel 11 of the right side end, through the leading edge side passage 12 while cooling the leading edge side and through the tunnel 11 of the left side end to enter the space 21. The cooling air in the space 21 flows through the tunnel 18 of the left side end while cooling a surface of the left side end portion of the inner shroud 2 to enter the air reservoir 19-1 and is then blown out of holes of the trailing edge side while cooling the trailing edge side of the left side end.

It is to be noted, in the second embodiment as mentioned above, that although an example of three stationary blades being fixed to the inner shroud 2 has been described, the present invention is not limited to this example using a segment of three stationary blades but may be constructed by use of a segment of two, or four or more, stationary blades.

In the first and second embodiments according to the present invention as described above, the inner shroud 2 is constructed with one or three stationary blades fixed thereto, and the cooling air is supplied into the independent air passage 3A of the leading edge side of each stationary blade to flow into the space 22 or 22*a*, 22*b* and 22*c* covered and sealed by the cover 14 to cool the surface of the shroud and then passes through the tunnel 18 and the air reservoirs 19-2, 19-3 and 19-4 to be blown out of the trailing edge. Also, the cooling air flows through the tunnel 11 and the leading edge side passage 12 from the space 22 or 22*b* to cool the leading edge side and enters the space 21 to cool the surface of the left side end of the shroud and, passing through the tunnel 18 and the air reservoir 19-1, is blown out of the leading edge side while cooling the trailing edge portion of the left side.

According to the present invention as so constructed, the entire area of the leading edge, middle portion, trailing edge and both end portions of the shroud can be cooled by use of a cooling air and further, three stationary blades being fixed to the inner shroud integrally in one unit, each portion to be cooled of the blades can be cooled integrally, hence the cooling passages can be simplified and the cooling performance of the shroud can be enhanced.

It is understood that the invention is not limited to the particular construction and arrangement herein illustrated and described but embraces such modified forms thereof as come within the scope of the following claims.

What is claimed is:

1. A cooled shroud of a gas turbine stationary blade in which a cooling air is supplied into an inner shroud through a stationary blade leading edge side air passage, wherein an interior of said inner shroud is sectioned into a ventral side and a dorsal side of the stationary blade so as to form a first space on the ventral side and a second space on the dorsal side, said first space communicating with said stationary blade leading edge side air passage, and there is provided on a leading edge side of said inner shroud a shroud side air passage for causing said first space and second space to communicate with each other and the cooling air which flows into said first space from said stationary blade leading edge side air passage is discharged to a trailing edge side from said first space on one hand, and is flown into said second space through said shroud side air passage and is discharged to the trailing edge side from said second space on the other hand.

2. A cooled shroud of a gas turbine stationary blade as claimed in claim 1, wherein said inner shroud is fixed with a plurality of stationary blades in the circumferential direction, said second space is formed on the dorsal side of the stationary blade of the endmost portion and said first space is formed so as to cover all the remaining stationary blades.

* * * * *